US009273422B2

(12) United States Patent
Inli

(10) Patent No.: US 9,273,422 B2
(45) Date of Patent: Mar. 1, 2016

(54) REED TOOTH OF HOSIERY STITCHING MACHINE

(71) Applicant: DA KONG ENTERPRISE CO., LTD., Changhua (TW)

(72) Inventor: Mustafa Inli, Istanbul (TR)

(73) Assignee: DA KONG ENTERPRISE CO., LTD., Changhua (TW)

( * ) Notice: Subject to any disclaimer, the term of this patent is extended or adjusted under 35 U.S.C. 154(b) by 0 days.

(21) Appl. No.: 14/220,085

(22) Filed: Mar. 19, 2014

(65) Prior Publication Data

US 2015/0135776 A1 May 21, 2015

(30) Foreign Application Priority Data

Nov. 15, 2013 (TW) ..... 102141696 A

(51) Int. Cl.

| | |
|---|---|
| ***D05B 23/00*** | (2006.01) |
| ***D04B 15/02*** | (2006.01) |
| ***D04B 9/40*** | (2006.01) |
| ***D04B 9/56*** | (2006.01) |

(52) U.S. Cl.

CPC ..... *D05B 23/009* (2013.01); *D04B 9/40* (2013.01); *D04B 9/56* (2013.01); *D04B 15/02* (2013.01)

(58) Field of Classification Search

CPC ..... D04B 15/02; D04B 9/40; D04B 9/56; D05B 23/009

USPC ..... 66/148, 147, 58, 59, 150, 149 R

See application file for complete search history.

(56) References Cited

U.S. PATENT DOCUMENTS

| | | | | | |
|---|---|---|---|---|---|
| 179,403 | A * | 7/1876 | Davison et al. | ..... | 66/148 |
| 625,259 | A * | 5/1899 | Hamilton et al. | ..... | 66/148 |
| 673,874 | A * | 5/1901 | Houseman | ..... | 66/148 |
| 697,616 | A * | 4/1902 | Franck | ..... | 66/95 |
| 765,385 | A * | 7/1904 | Houseman | ..... | 66/148 |
| 801,457 | A * | 10/1905 | Hemphill | ..... | 66/148 |
| 1,245,546 | A * | 11/1917 | Williams | ..... | 66/148 |
| 1,353,793 | A * | 9/1920 | Sibbald et al. | ..... | 112/27 |
| 4,010,626 | A * | 3/1977 | Feher | ..... | 66/93 |
| 6,089,049 | A * | 7/2000 | Dawn | ..... | 66/148 |
| 6,381,991 | B2 * | 5/2002 | Ando' | ..... | 66/58 |
| 8,443,633 | B1 * | 5/2013 | Inli | ..... | 66/148 |
| 8,893,529 | B1 * | 11/2014 | Inli | ..... | 66/148 |
| 2002/0000106 | A1 * | 1/2002 | Sangiacomo | ..... | 66/95 |
| 2010/0199723 | A1 * | 8/2010 | Conti | ..... | 66/13 |

FOREIGN PATENT DOCUMENTS

| | | | |
|---|---|---|---|
| EP | 2377979 | A1 * | 10/2011 |
| TW | 201144506 | | 12/2011 |

* cited by examiner

*Primary Examiner* — Khoa Huynh
*Assistant Examiner* — James Heracklis
(74) *Attorney, Agent, or Firm* — DLA Piper LLP (US)

(57) ABSTRACT

A reed tooth for a hosiery stitching machine, which includes a fixed reed, includes a positioning portion for positioning to the fixed reed, first and second sidewalls, and an intermediate wall cooperating with the first and second sidewalls to define a slide groove. The first sidewall has a tapered bottom end that includes a bottommost tip and an inclined edge. The second sidewall has a length shorter than that of the first side wall, and has a tapered bottom end that includes a bottommost end, and an inclined edge that extends upwardly from the bottommost end of the second sidewall. The inclined edge of the second sidewall and the inclined edge of the first sidewall cooperatively define a bottom opening of the slide groove.

3 Claims, 14 Drawing Sheets

REED TOOTH OF HOSIERY STITCHING MACHINE

CROSS REFERENCE APPLICATION

This application claims priority of Taiwanese Patent Application No. 102141695, filed on Nov. 15, 2013.

BACKGROUND OF THE INVENTION

1. Field of the Invention

This invention relates to hosiery equipment, more particularly to a reed tooth of a hosiery stitching machine.

2. Description of the Related Art

A hosiery item, for example, a stocking, after being manufactured in a knitting machine, generally has a tubular shape with two opposite ends that are open. The stocking has to be sent to another machine for closing one of the ends thereof, that is, the toe end.

In Taiwanese Patent Publication No. 201144506, it is disclosed that a hosiery body, for example, a stocking body, made by a knitting machine can be transferred to a hosiery stitching machine using a transfer device of this application. The hosiery stitching machine includes two semi-circular reeds, a plurality of male reed teeth arranged spaced apart from each other around a semi-circumference of one of the reeds, a plurality of female reed teeth arranged spaced apart from each other around a semi-circumference of the other reed, and a sewing needle. The reeds are pivotable relative to each other between a stacked position, where the reeds are superimposed one above the other, and a juxtaposed position, where the reeds are disposed side by side in a same plane. When the reeds are in the juxtaposed position, a plurality of transfer and strip members of the transfer device can transfer loops at the toe end of the stocking body from the knitting machine to the reeds, after which the reeds are pivoted to the stacked position. The sewing needle is then used to stitch the loops together to thereby close the toe of the stocking.

It is also disclosed in the aforesaid publication that each of the male reed teeth has an extension portion that extends downwardly and that terminates with a pointed end, and a guide hole formed in one side of the extension portion that faces outward. The pointed ends of the male reed teeth mate with notched ends of the female reed teeth when the reeds are in the stacked position.

To transfer the loops at the toe end of the stocking body from the knitting machine to the reeds, the transfer and strip members are first moved upward toward the reeds, so that the male and female reed teeth can be inserted into passages of the transfer members to thereby transfer the loops to the male and female reed teeth. When the male and female reed teeth are mated, the strip members are operated to push the loops which are sleeved on the female reed teeth toward the loops which are sleeved on the male reed teeth, after which the sewing needle is used to stitch together the loops, thereby achieving the purpose of closing the toe end of the hosiery body. The sewing needle is guided by the guide hole during the stitching operation.

Although the transfer and stitching operations of the loops can be achieved through coordination of the male and female reed teeth, the transfer and strip members, and the sewing needle, because the male reed teeth must be provided with guide holes, the cross sectional area thereof is large. When each loop is sleeved on one of the male reed tooth, it is likely that a frictional contact exists between the two, so that the loop is likely to get damaged, thereby adversely affecting the smooth execution of the transfer and stitching operations.

SUMMARY OF THE INVENTION

Therefore, the object of the present invention is to provide a reed tooth of a hosiery stitching machine that can provide a high component stability and a smooth stitching operation.

According to this invention, a reed tooth for a hosiery stitching machine which includes a fixed reed is provided. The reed tooth is adapted to receive a loop of a toe end of a hosiery body transferred by a transfer device from a knitting machine to the reed tooth. The transfer device includes a transfer member and a strip member. the reed tooth comprises a positioning portion for positioning to the fixed reed, and a leg rod having an upper portion connected to the positioning portion, and a lower portion extending downwardly from the upper portion. The leg rod has a substantially U-shaped cross section and includes a first sidewall, a second sidewall opposite to the first sidewall, and an intermediate wall interconnecting the first and second sidewalls. The first and second sidewalls and the intermediate wall cooperatively define a slide groove that has a lateral opening opposite to the intermediate wall, a top opening proximate to the positioning portion, and a bottom opening opposite to the top opening. The upper portion has the top opening. The lower portion has the bottom opening. The slide groove is adapted to receive and permit the transfer member to slide therealong. The first sidewall has a tapered bottom end that is opposite to the positioning portion and that includes a bottommost tip, and an inclined edge extending upwardly from the bottommost tip and extending gradually away from the intermediate wall. The second sidewall has a length shorter than that of the first sidewall, and has a tapered bottom end that includes a bottommost end which is higher than the bottommost tip of the first sidewall and which meets the intermediate wall, and an inclined edge that extends upwardly from the bottommost end of the second sidewall and that extends gradually away from the intermediate wall. The inclined edge of the second sidewall and the inclined edge of the first sidewall cooperatively define the bottom opening of the slide groove.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
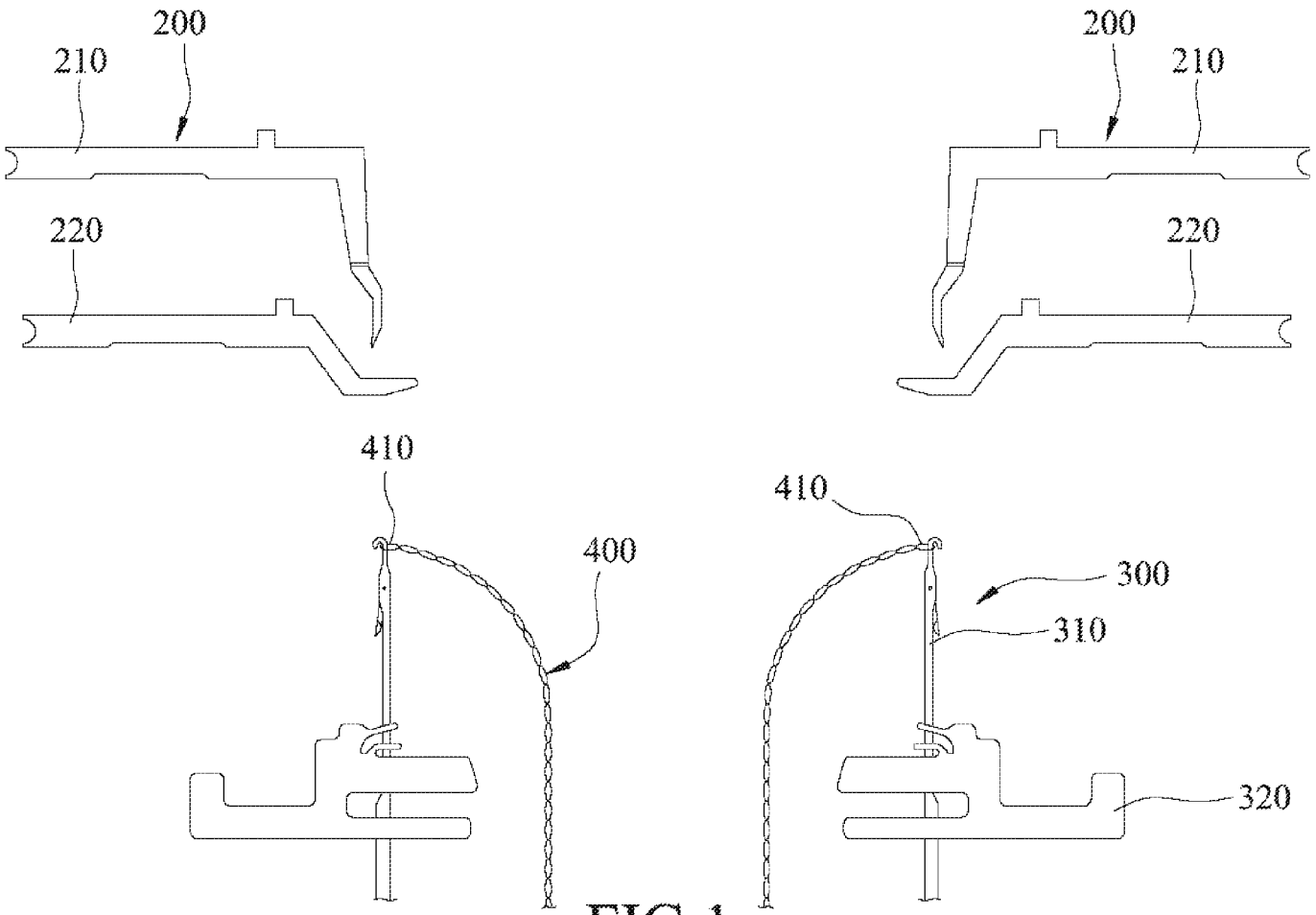
FIG. 1 is a schematic view of a transfer device and a knitting machine that will be used to coordinate with a reed tooth according to the preferred embodiment of the present invention.
Figure 2:
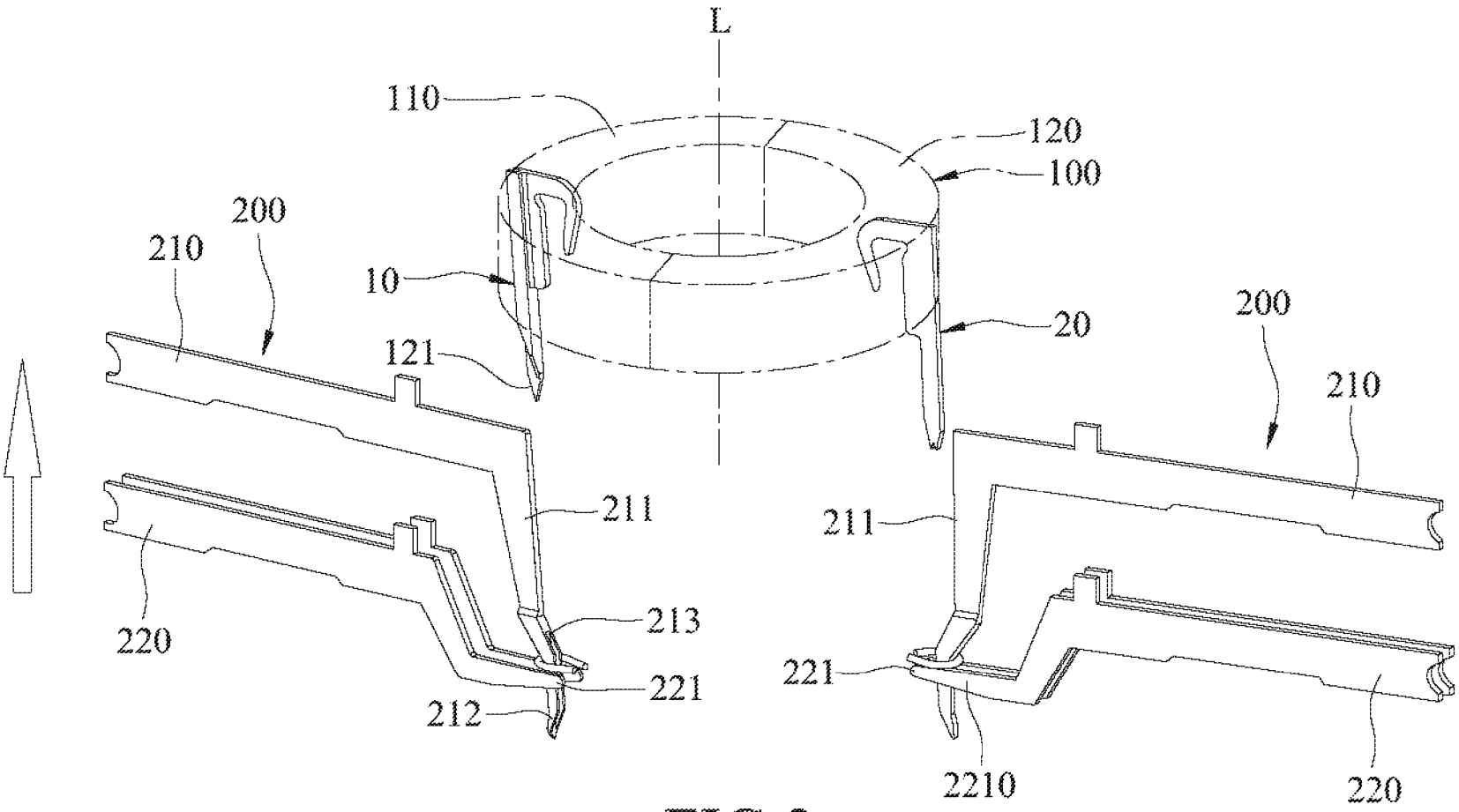
FIG. 2 is a schematic view, illustrating how loops are transferred by transfer and strip members of the transfer device toward the reed tooth of the preferred embodiment that is mounted to a fixed reed of a stitching machine and a reed tooth that is mounted to a movable reed of the stitching machine.

Referring to FIGS. 1 and 2, a hosiery stitching machine 100 is shown to incorporate reed teeth 10 (only one is shown in FIG. 2) according to the preferred embodiment of the present invention. The hosiery stitching machine 100 (shown in phantom lines in FIG. 2) includes a fixed reed 110 and a movable reed 120. Each reed tooth 10 of the present invention is mounted to the fixed reed 110. A plurality of reed teeth 20 are mounted to the movable reed 120. The hosiery stitching machine 100 coordinates with a transfer device 200 which transfers loops 410 at a toe end of a tubular hosiery body 400 knitted by a knitting machine 300 to the reed teeth 10 and the reed teeth 20, after which a sewing needle 500 (see FIG. 14) is used to stitch and close the toe end of the hosiery body 400. The knitting machine 300 includes a plurality of knitting needles 310 and a plurality of sinkers 320. The loops 410 are hooked to the knitting needles 310 after the hosiery body 400 is knitted by the knitting machine 300. The transfer device 200 includes a plurality of transfer members 210, and a plurality of strip members 220 respectively disposed below the transfer members 210. Each of the transfer members 210 has a flat plate portion 211, a pair of insert plate portions 212 extending downwardly from a bottom end of the flat plate portion 211, and an insert groove 213 defined by the insert plate portions 212. Each of the strip members 220 has a fork end portion 221 that includes a pair of prongs 2210 extendable to outer sides of the pair of the insert plate portions 212. The number of the reed teeth 10 mounted to the fixed reed 110 is similar to that of the reed teeth 20 mounted to the movable reed 120. In this embodiment, only one reed tooth 10 will be described in detail hereinafter.

Figure 3:
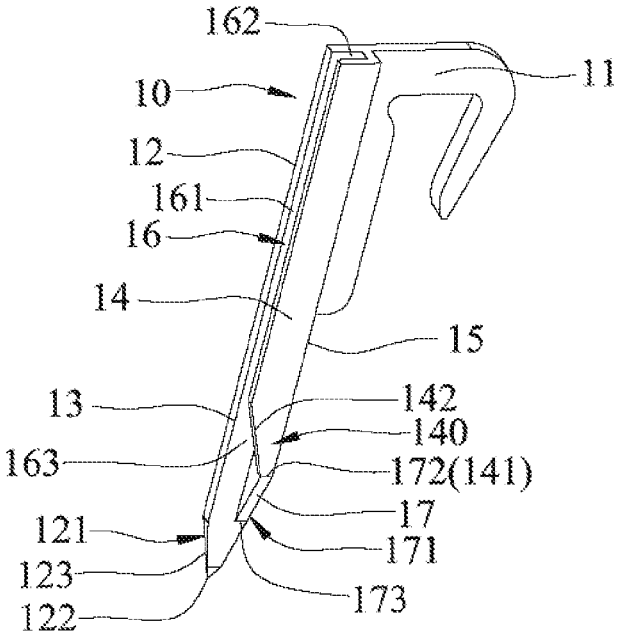
FIG. 3 is a perspective view of the reed tooth of the preferred embodiment.
Figure 4:
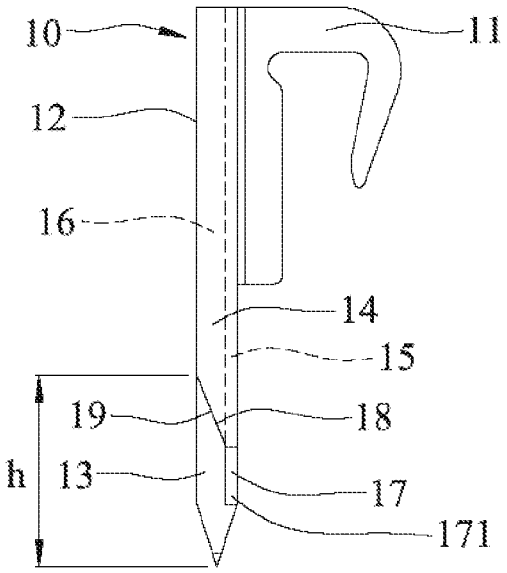
FIG. 4 is a schematic front view of the reed tooth of the preferred embodiment.
Figure 5:
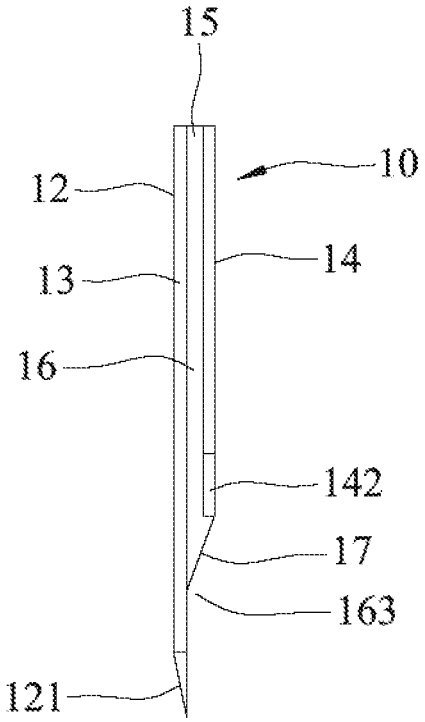
FIG. 5 is a schematic side view of the reed tooth of the preferred embodiment.

Referring to FIGS. 3 to 5, the reed tooth 10 includes a positioning portion 11 positioned to the fixed reed 110 (see FIG. 2), and a leg rod 12 having an upper portion connected to the positioning portion 11 and a lower portion extending downwardly from the upper portion. The leg rod 12 has a substantially U-shaped cross section, and includes a first sidewall 13, a second sidewall 14 opposite to the first sidewall 13, and an intermediate wall 15 interconnecting the first and second sidewalls 13, 14. The first and second sidewalls 13, 14 and the intermediate wall 15 cooperatively define a slide groove 16. The first sidewall 13 has a tapered bottom end 121 that is opposite to the positioning portion 11 and that includes a bottommost tip 122, and an inclined edge 123 extending upwardly from the bottommost tip 122 and extending gradually away from the intermediate wall 15. The second sidewall 14 has a length shorter than that of the first sidewall 13. Further, the second sidewall 14 has a tapered bottom end 140 opposite to the positioning portion 11. The tapered bottom end 140 includes a bottommost end 141 which is higher than the bottommost tip 122 of the first sidewall 13, and an inclined edge 142 that extends upwardly from the bottommost end 141 and that extends gradually away from the intermediate wall 15. The intermediate wall 15 has a tapered bottom end 17 that includes an inclined edge 171. The inclined edge 171 has a topmost end 172 meeting with the bottommost end 141 of the second sidewall 14, and a bottommost end 173 meeting with the first sidewall 13 above the bottommost tip 122. The slide groove 16 has a lateral opening 161 opposite to the intermediate wall 15, a top opening 162 proximate to the positioning portion 11, and a bottom opening 163 opposite to the top opening 162. The upper portion of the leg rod 12 has the top opening 162, while the lower portion thereof has the bottom opening 163. The inclined edge 142 of the second sidewall 14 and the inclined edge 123 of the first sidewall 13 cooperatively define the bottom opening 163 of the slide groove 16. A bottommost end of the inclined edge 142 of the second sidewall 14 is higher than a topmost end of the inclined edge 123 of the first sidewall 13. A topmost end of the inclined edge 142 is spaced apart from the bottommost tip 122 by a height (h). Through this configuration, the bottom opening 163 of the slide groove 16 is enlarged.

As shown in FIGS. 1 and 2, when the loops 410 at the toe end of the hosiery body 400 are transferred from the knitting needles 310 of the knitting machine 300 to the transfer members 210 and the strip members 220 of the transfer device 200, the transfer device 200 can then transfer the hosiery body 400 below the stitching machine 100. At this time, the fixed reed 110 and the movable reed 120 are disposed side by side to form a 180° angle.

Figure 7:
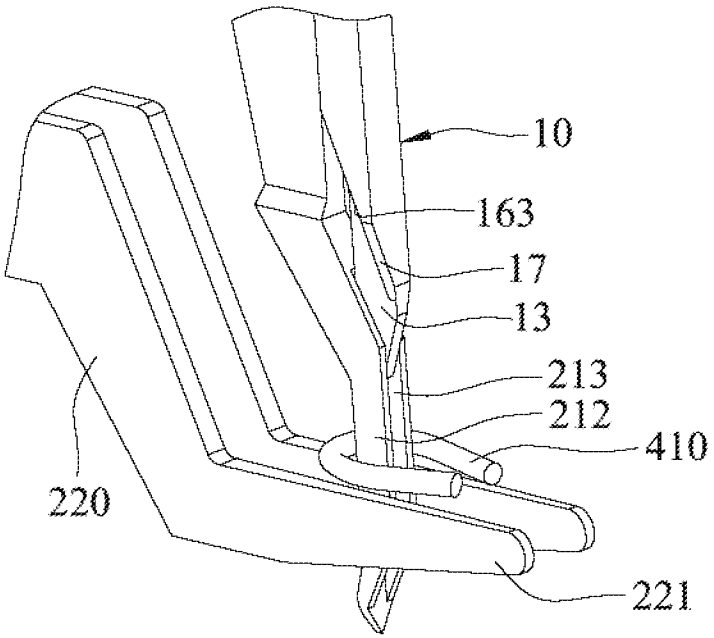
FIG. 7 is an enlarged fragmentary perspective view of FIG. 6.
Figure 6:
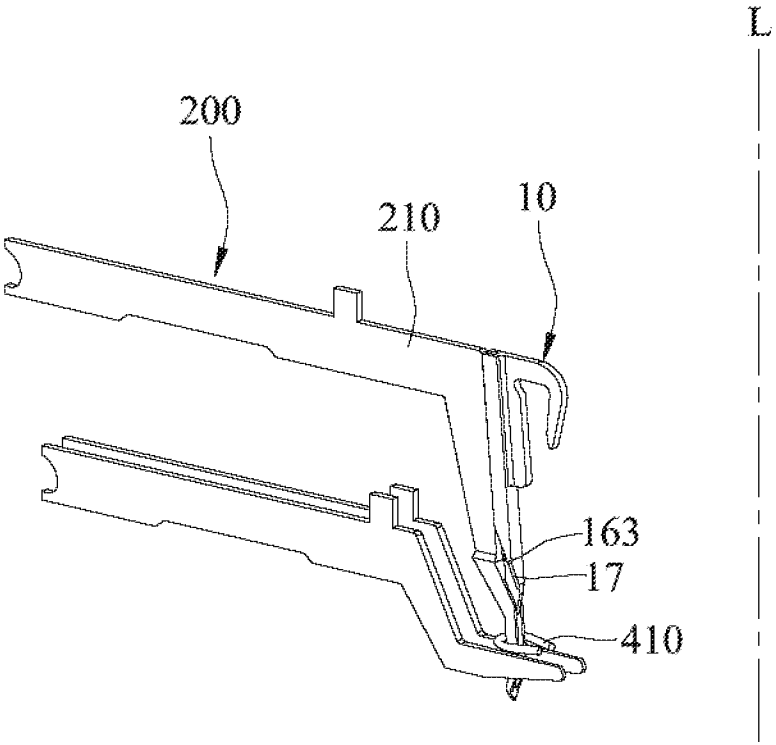
FIG. 6 illustrates how a loop is transferred by the transfer device to the reed tooth of the preferred embodiment.

Referring to FIGS. 6 and 7, in combination with FIG. 2, when the transfer device 200 moves upward toward the stitching machine 100 along an axis (L) thereof, a top end of the flat plate portion 211 of the transfer member 210 is inserted into the slide groove 16 of the reed tooth 10 via the bottom opening 163, and the flat plate portion 211 of the transfer member 210 slides in the slide groove 16 of the reed tooth 10 until the tapered bottom end 121 of the reed tooth 10 is inserted into the insert groove 213. Simultaneously, the flat plate portion 211 of another transfer member 210 is also slid upward along the reed tooth 20 through a bottom portion thereof until a bottom end of the reed tooth 20 is inserted into the insert groove 213 (not shown) of said another transfer member 210. During insertion of the top end of the flat plate portion 211 into the slide groove 16 via the bottom opening 163, because the topmost end of the inclined edge 142 of the second sidewall 14 is spaced apart from the bottommost tip 122 of the first sidewall 13 by the height (h) and because of the upward inclination of the inclined edge 142, a wide guide entrance is provided at the bottom opening 163 of the slide groove 16, so that the flat plate portion 211 of the transfer member 210 can be guided smoothly into the slide groove 16.

Figure 8:
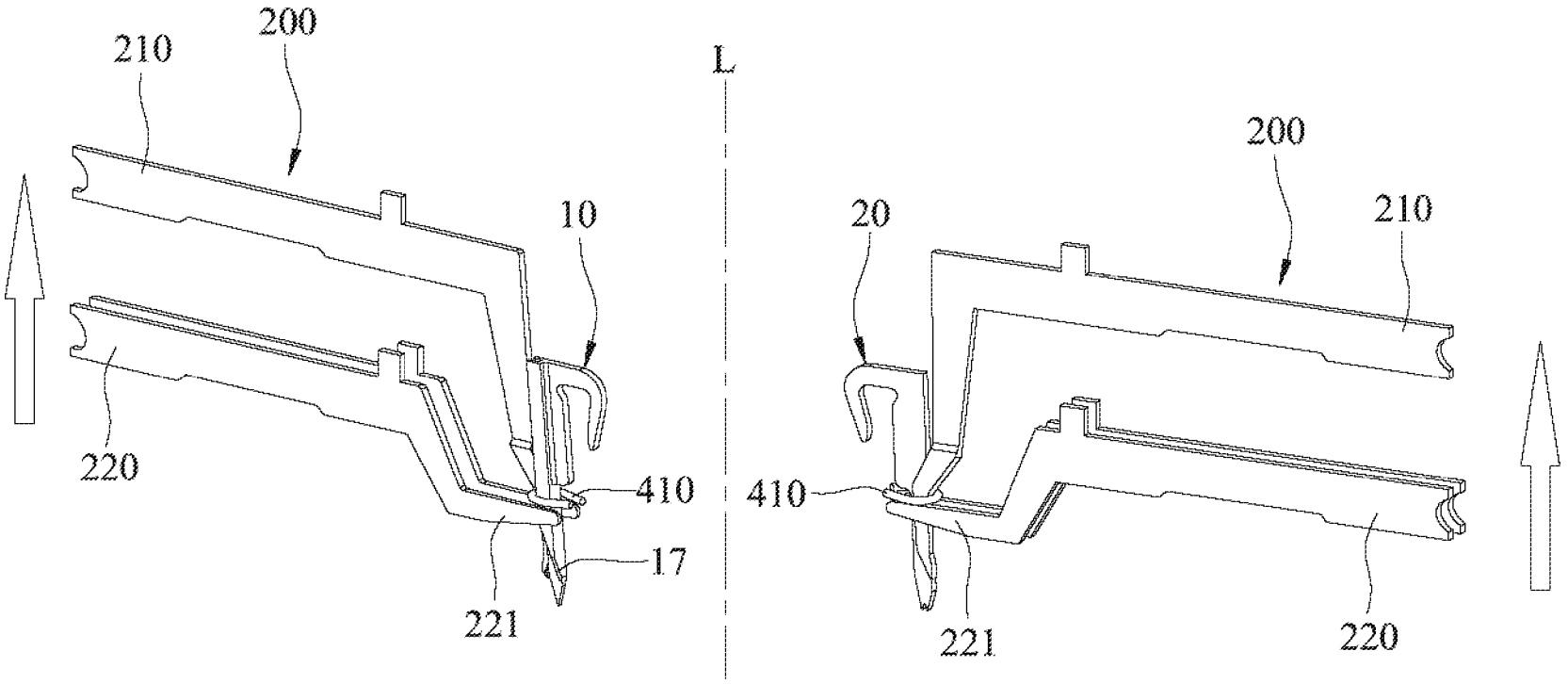
FIG. 8 illustrates how the transfer members and the strip members transfer the loops to the reed tooth of the preferred embodiment and the reed tooth of the movable reed.
Figure 11:
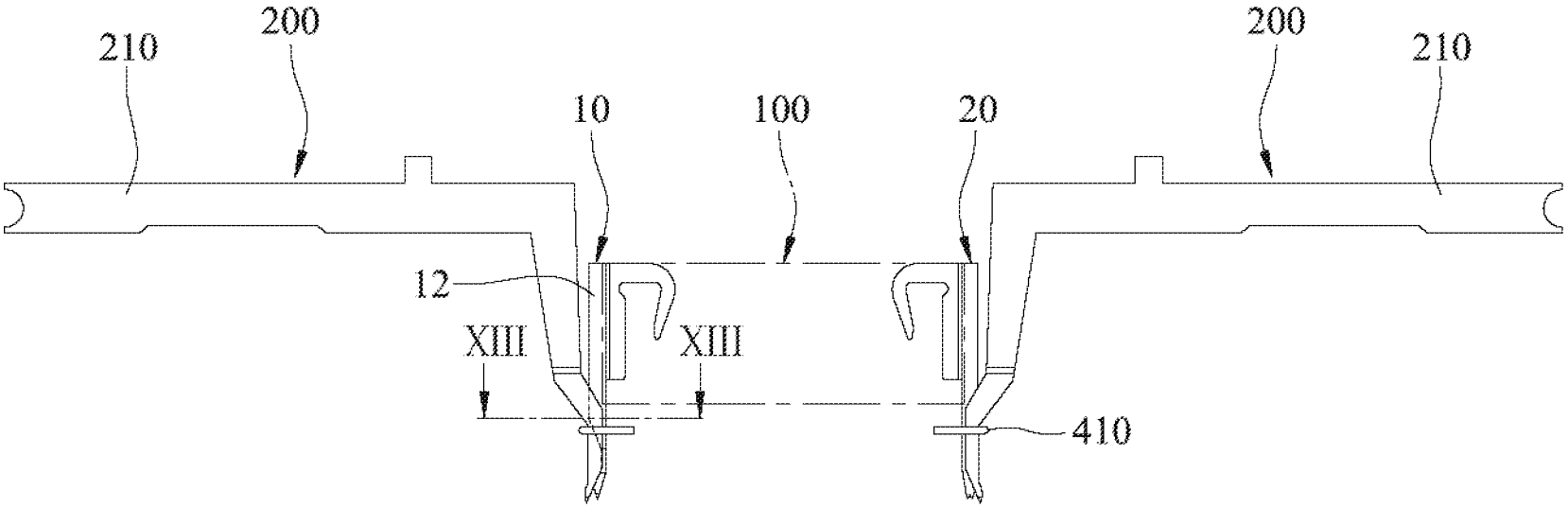
FIG. 11 illustrates a sliding relationship between each transfer member and a respective one of the reed tooth of the preferred embodiment and the reed tooth of the movable reed.
Figure 12:
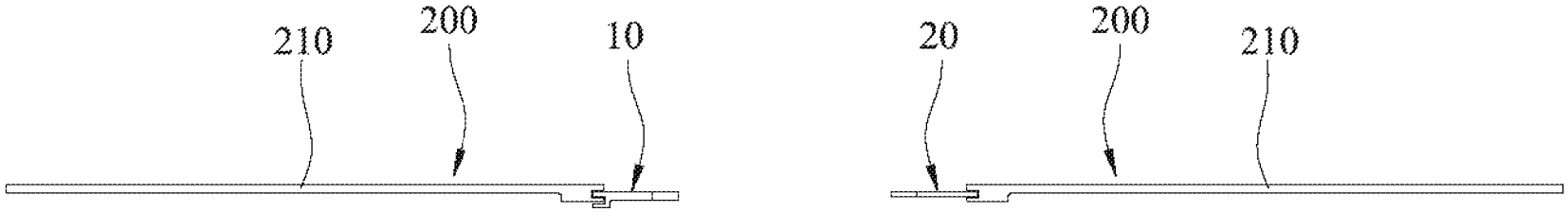
FIG. 12 is a schematic top view of FIG. 11.
Figure 13:
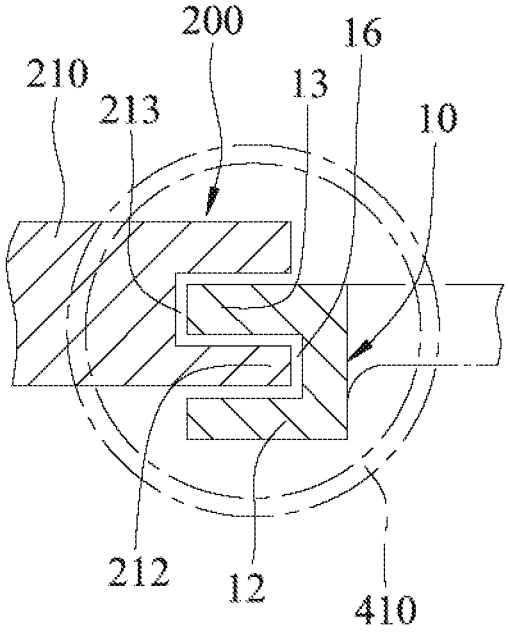
FIG. 13 is a sectional view taken along line XIII-XIII of FIG. 11.

With reference to FIG. 8, when the strip members 220 continuously push the loops 410 upwardly so as to be sleeved on the reed tooth 10 and the reed tooth 20, that is, the loops 410 are pushed upwardly by the fork end portions 221 of the strip members 220, because of the inclined edge 171 of the tapered bottom end 17 of the intermediate wall 15 of the reed tooth 10, the loop 410 can be guided to slide smoothly along the lower portion of the leg rod 12. With reference to FIGS. 11 to 13, as the strip member 220 continuously pushes the loop 410 upwardly along the lower portion of the leg rod 12, the first sidewall 13 is inserted slidably into the insert groove 213 of the transfer member 210, while one of the insert plate portions 212 is inserted slidably into the slide groove 16. Because the cross sectional shape of the transfer member 210 and the cross sectional shape of the leg rod 12 of the reed tooth 10 are complementary to each other, smooth and stable relative sliding movement between the transfer member 210 and the leg rod 12 can be enhanced.

Figure 9:
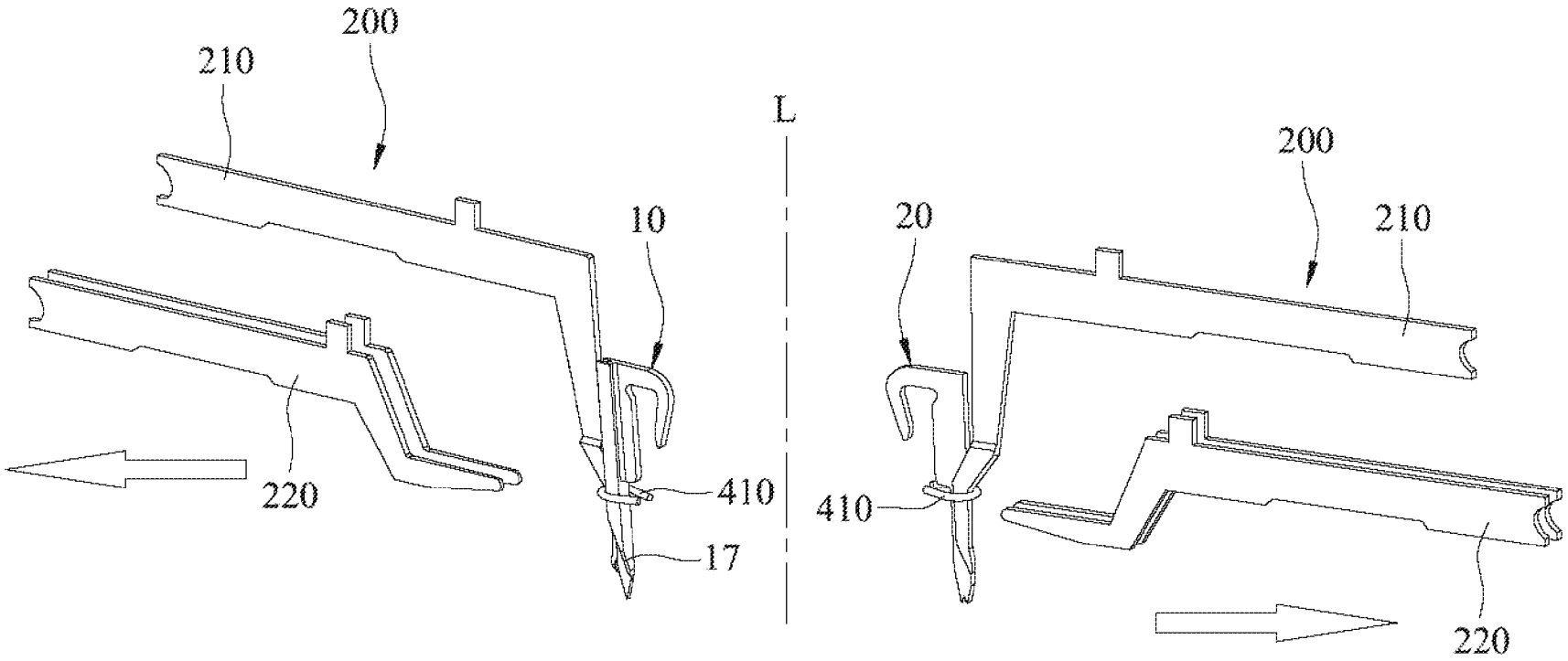
FIG. 9 illustrates the strip members being moved outwardly in a direction that is perpendicular to an axis.
Figure 10:
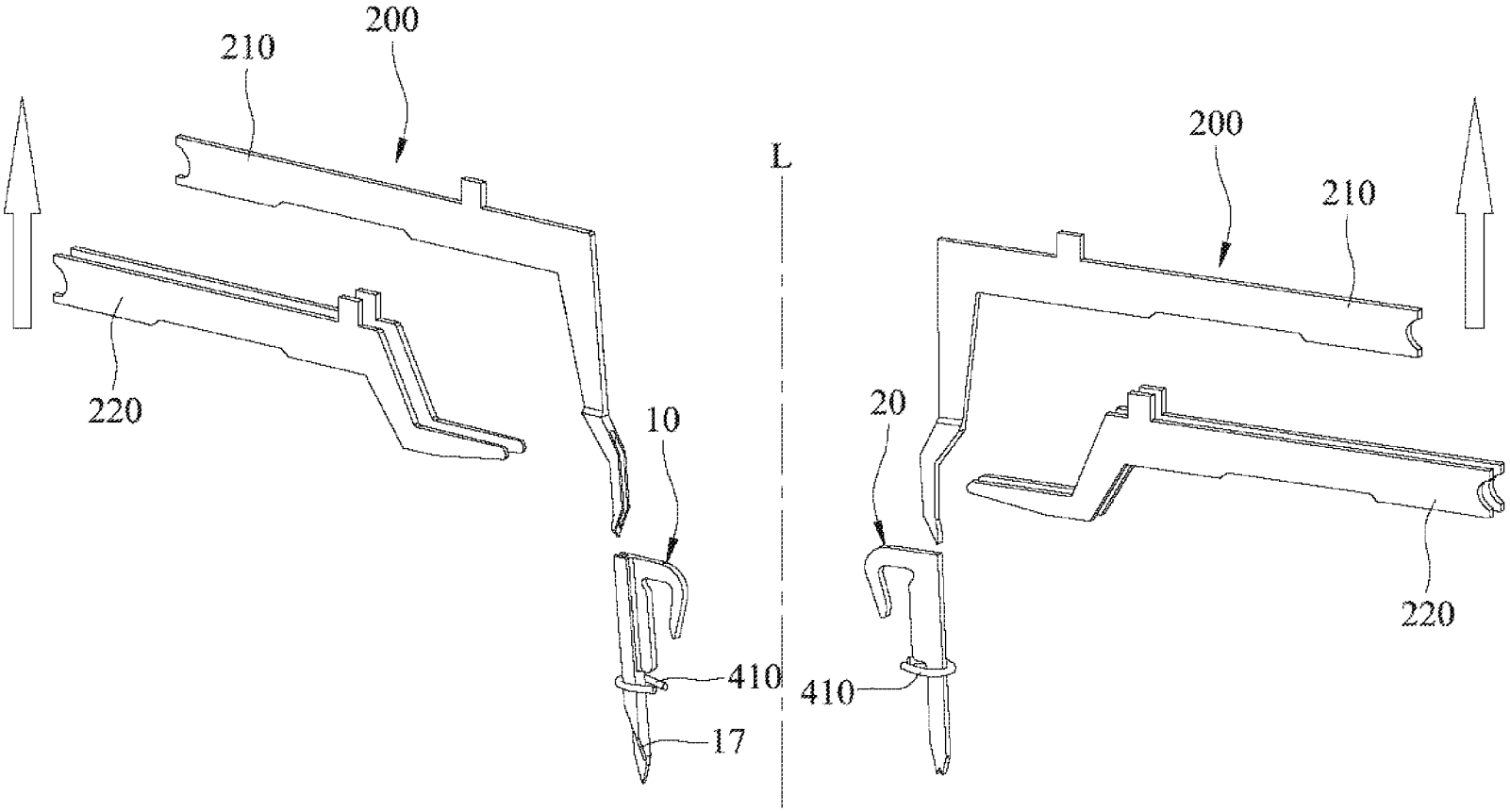
FIG. 10 illustrates the transfer and strip members being moved upward in an axial direction.

As shown in FIG. 9, the strip members 220 of the transfer device 200 are first moved radially outward in a direction perpendicular to the axis (L), after which, as shown in FIG. 10, the transfer and the strip members 210, 220 are simultaneously moved upward along an axial direction, so that the transfer device 200 can be released from clamping the loops 410 and can be moved away from the reed tooth 10 and the reed tooth 20. At this time, the loops 410 are smoothly transferred to the reed tooth 10 and the reed tooth 20, respectively.

Figure 14:
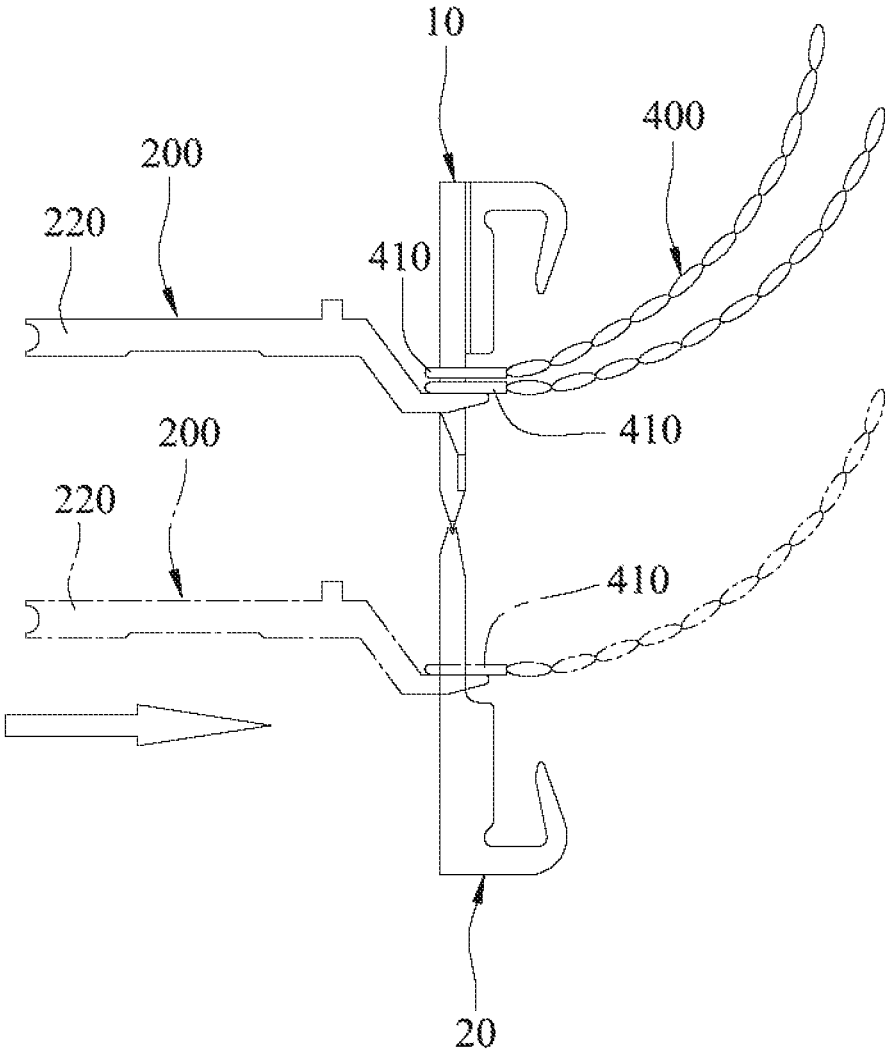
FIG. 14 illustrates how the strip member is moved upward to push the loop that is sleeved on the reed tooth of the movable reed toward the loop that is sleeved on the reed tooth of the preferred embodiment.

With reference to FIG. 14, when the movable reed 120 is rotated relative to the fixed reed 110 from a juxtaposed position (see FIG. 2) to a stacked position (not shown), where the movable reed 120 is stacked below the fixed reed 110, a bottommost tip of the reed tooth 20 mates with the bottommost tip of the reed tooth 10 along the axial direction.

As shown in phantom in FIG. 14, the strip member 220 is operated to move radially toward the reed tooth 20 and then axially upward so as to push the loop 410 that is sleeved on the reed tooth 20 closer to the loop 410 that is sleeved on the reed tooth 10.

Figure 15:
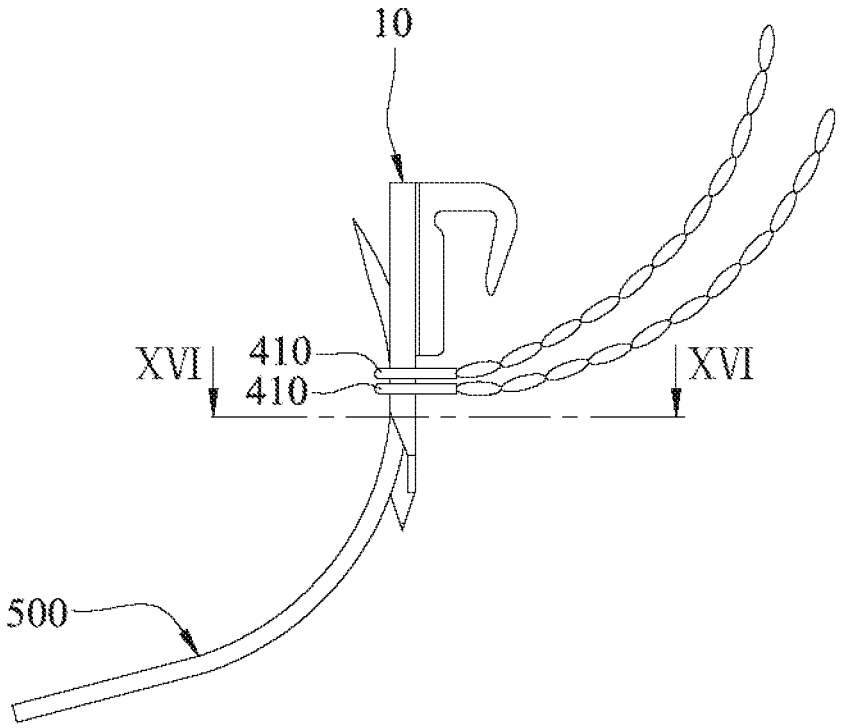
FIG. 15 illustrates a sewing needle in a stitching operation.
Figure 16:
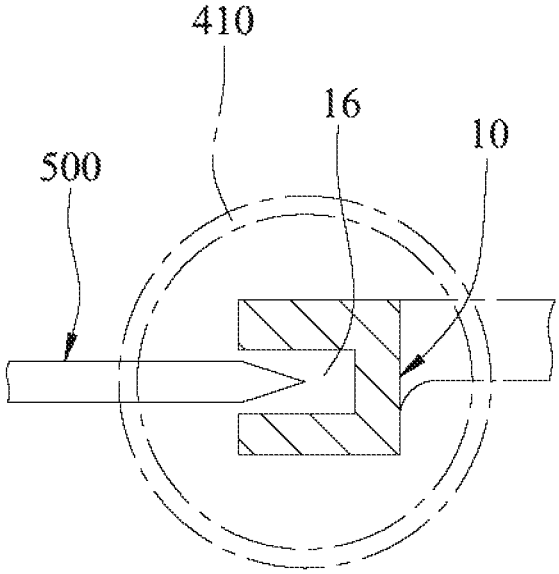
FIG. 16 is a sectional view taken along line XVI-XVI of FIG. 15.

Afterwards, with reference to FIGS. 15 and 16, the sewing needle 500 is operated to execute a stitching operation by extending the sewing needle 500 into the slide groove 16 of the reed tooth 10. As a result, the sewing needle 500 can sew together the loops 410 that are sleeved on the reed tooth 10.

Hence, by repeating the aforesaid operating steps, closing of the toe end of the hosiery body 400 by stitching can be accomplished.

After completing the closing of the toe end of the hosiery body 400, the strip members 220 of the transfer device 200 are again operated to move downward in the axial direction, and by using the fork end portions 221 of the strip members 220, the sewn loops 410 can be pushed downward and out of the reed tooth 10. Preparation for the transfer operation of the next hosiery body 400 can then be executed.

In sum, by using the structure of the reed teeth 10 of the present invention, in coordination with the stitching machine 100 and the transfer device 200, the toe end of the hosiery body 400 can be transferred from the knitting machine 300 to the stitching machine 100, after which the sewing needle 500 is operated to execute the stitching operation. Not only is the purpose of closing the toe end of the hosiery body 400 can be achieved, through the unusual structure of the reed teeth 10, easy connection and stable sliding with the transfer members 210 can be provided. Further, because the tapered bottom end 17 of the intermediate wall 15 of each reed tooth 10 includes the inclined edge 171, the loop 410 can be guided to slide smoothly along the leg rod 12 of each reed tooth 10.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

What is claimed is:

1. A reed tooth for a hosiery stitching machine which includes a fixed reed, said reed tooth being adapted to receive a loop of a toe end of a hosiery body transferred by a transfer device from a knitting machine to said reed tooth, the transfer device including a transfer member and a strip member, said reed tooth comprising:

a positioning portion for positioning to the fixed reed; and a leg rod having an upper portion connected to said positioning portion, and a lower portion extending downwardly from said upper portion, said leg rod having a substantially U-shaped cross section and including a first sidewall, a second sidewall opposite to said first sidewall, and an intermediate wall interconnecting said first and second sidewalls, each of said first and second sidewalls having a first end connected to said intermediate wall, and a second end opposite to said first end and said intermediate wall, said first and second sidewalls and said intermediate wall cooperatively defining a slide groove that has a lateral opening opposite to said intermediate wall, a top opening proximate to said positioning portion, and a bottom opening opposite to said top opening, said upper portion having said top opening, said lower portion having said bottom opening, said slide groove being adapted to receive and permit the transfer member to slide therealong, said first sidewall having a tapered bottom end that is opposite to said positioning portion and that includes a bottommost tip and an inclined edge, said first and second ends of said first sidewall extending to and forming an angle at said bottommost tip, said inclined edge being formed on said second end of said first sidewall and extending upwardly and inclinedly from said bottommost tip, said inclined edge being inclined with respect to a plane of said intermediate wall, said second sidewall being shorter than said first sidewall such that said second sidewall has a tapered bottom end with a bottommost end which is higher than said bottommost tip of said first sidewall, said bottommost end of said tapered bottom end of said second sidewall meeting said intermediate wall, said second sidewall further having an inclined edge that is formed on said second end of said second sidewall and that extends upwardly and inclinedly from said bottommost end of said tapered bottom end of said second sidewall, said inclined edge of said second sidewall being inclined with respect to the plane of said intermediate wall, said inclined edge of said second sidewall and said inclined edge of said first sidewall cooperatively defining said bottom opening of said slide groove.

2. The reed tooth according to claim 1, wherein said intermediate wall has a tapered bottom end that includes an inclined edge, said inclined edge of said intermediate wall having a topmost end meeting with said bottommost end of said second sidewall, and a bottommost end extending downwardly and inclinedly from said topmost end and meeting with said first sidewall above said bottommost tip of said first sidewall.

3. The reed tooth according to claim 1, wherein a bottommost end of said inclined edge of said second sidewall is higher than a topmost end of said inclined edge of said first sidewall.

* * * * *